US008615184B2

(12) United States Patent
Zhou et al.

(10) Patent No.: US 8,615,184 B2
(45) Date of Patent: Dec. 24, 2013

(54) DRIVING COMPONENT, PHOTOSENSITIVE DRUM AND PROCESS CARTRIDGE HAVING THE DRIVING COMPONENT

(75) Inventors: Honghui Zhou, Guangdong (CN); Zhiya He, Guangdong (CN)

(73) Assignee: Print-Rite • Unicorn Image Products Co., Ltd of Zhuhai, Zhuhai (CM)

( * ) Notice: Subject to any disclaimer, the term of this patent is extended or adjusted under 35 U.S.C. 154(b) by 304 days.

(21) Appl. No.: 13/141,083

(22) PCT Filed: Jun. 7, 2010

(86) PCT No.: PCT/CN2010/073622

§ 371 (c)(1),
(2), (4) Date: Jun. 21, 2011

(87) PCT Pub. No.: WO2011/050613

PCT Pub. Date: May 5, 2011

(65) Prior Publication Data

US 2011/0255900 A1 Oct. 20, 2011

(30) Foreign Application Priority Data

Oct. 27, 2009 (CN) ..... 2009 2 0238326 U

(51) Int. Cl.
*G03G 15/00* (2006.01)

(52) U.S. Cl.
USPC ..... 399/111; 399/167; 74/405; 74/412 R

(58) Field of Classification Search
USPC ..... 399/111, 167; 74/405, 412 R
See application file for complete search history.

(56) References Cited

U.S. PATENT DOCUMENTS

| | | | | |
|---|---|---|---|---|
| 4,829,335 | A | 5/1989 | Kanemitsu et al. | |
| 5,845,175 | A * | 12/1998 | Kumar et al. | 399/111 |
| 5,903,803 | A | 5/1999 | Kawai et al. | |
| 6,397,029 | B1 * | 5/2002 | Portig | 399/167 |
| 6,771,927 | B2 * | 8/2004 | Bloemen et al. | 399/358 |
| 2008/0044203 | A1 * | 2/2008 | Ukai | 399/167 |
| 2008/0152388 | A1 | 6/2008 | Ueno et al. | |

OTHER PUBLICATIONS

International Search Report of PCT/CN2010/073622.

* cited by examiner

*Primary Examiner* — Walter L Lindsay, Jr.
*Assistant Examiner* — Jessica L Eley

(57) ABSTRACT

The present invention provides a driving component, and a photosensitive drum and a process cartridge comprising the driving component. The driving component comprises a gear fixed at one end of the photosensitive drum and a longitudinal regulating component. The longitudinal regulating component comprises a first motion subassembly, a groove part and a central shaft part. The groove part has an upper chute and a lower chute which are orthogonal in space. The first motion subassembly forms relative slide coordination with the upper chute along a first direction. The central shaft part has a common axis with the gear which forms relative slide coordination with the lower chute along a second direction. The first direction and the second direction are all perpendicular to the longitudinal direction of the photosensitive drum.

25 Claims, 7 Drawing Sheets

DRIVING COMPONENT, PHOTOSENSITIVE DRUM AND PROCESS CARTRIDGE HAVING THE DRIVING COMPONENT

CROSS-REFERENCE TO RELATED APPLICATIONS

This application claims priority from international application No. PCT/CN2010/073622 filed on Jun. 7, 2010, which claims priority from Chinese Patent Application Number 200920238326.2 filed on Oct. 27, 2009. These applications are incorporated herein by reference.

THE FIELD OF THE INVENTION

The present invention relates to a driving component, a photosensitive drum and a processing cartridge using the driving component.

BACKGROUND OF THE INVENTION

An electrophotographic image forming apparatus includes a copying machine, a laser printer and other similar devices.

Usually there is a process cartridge in the electrophotographic image forming apparatus. The process cartridge can be mounted to a main assembly of the electrophotographic image forming apparatus and be demounted from the main assembly. For example, the process cartridge is prepared by integrally assembling the photosensitive drum and at least one of a developing means, a charging means, and a cleaning means as the processing means into a cartridge.

Current process cartridges include the following types: a first type of a process cartridge prepared by integrally assembling a photosensitive drum, and a developing means, a charging means and a cleaning means into a cartridge; a second type of a process cartridge prepared by integrally assembling a photosensitive drum and a charging means into a cartridge; and a third type of a process cartridge prepared by integrally assembling a photosensitive drum and two processing units consisting of a charging means and a cleaning means.

A user can mount the above process cartridge to the main assembly of an electrophotographic image forming apparatus in a detachable way. Therefore, the user can maintain the apparatus without relying on a service person. As a result, the user's operability of the maintenance of the electrophotographic image forming apparatus is improved. In the above conventional process cartridge, the mechanism used for receiving a rotational driving force from an apparatus main assembly to rotate a photosensitive drum is described as follows.

On a main assembly side, a rotatable member for transmitting a driving force of a motor and a non circular twisted hole, which is provided at a center portion of the rotatable member and has a cross section integrally rotatable with the rotatable member and provided with a plurality of corners, are provided.

On a process cartridge side, a non circular twisted projection, which is provided at one of longitudinal ends of a photosensitive drum and has a cross section provided with a plurality of corners, is provided. When the rotatable member is rotated in an engaged state between the projection and the hole in the case where the process cartridge is mounted to the apparatus main assembly, a rotational driving force of the rotatable member is transmitted to the photosensitive drum. As a result, the rotational force for driving the photosensitive drum is transmitted from the apparatus main assembly to the photosensitive drum. Another known mechanism is to drive a photosensitive drum by engaging a gear fixed to the photosensitive drum thus to drive a process cartridge consisting of the photosensitive drum.

However, in the conventional constitution described in U.S. Pat. No. 5,903,803, the rotatable member is required to be moved in a horizontal direction when the process cartridge is mounted to or demounted from the main assembly by being moved in a direction substantially perpendicular to an axial line of the rotatable member. That is, the rotatable member is required to be horizontally moved by an opening and closing operation of a main assembly cover. By the opening operation of the main assembly cover, the hole is separated from the projection. On the other hand, by the closing operation of the main assembly cover, the hole is moved toward the projection so as to be engaged with the projection. Accordingly, in the conventional process cartridge, a mechanism for moving the rotatable member in a rotational axis direction by the opening and closing operation of the main assembly cover is required to be provided to the main assembly. In the constitution described in U.S. Pat. No. 4,829,335, without moving the driving gear provided to the main assembly along the axial line direction thereof, the cartridge can be mounted to and demounted from the main assembly by being moved in a direction substantially perpendicular to the axial line. However, in this constitution a driving connection portion between the main assembly and the cartridge is an engaging portion between gears, so that it is difficult to prevent rotation non uniformity of the photosensitive drum.

U.S. Pat. App. Pub. No. US2008/0152388A1 discloses another type of the process cartridge. The improvement compared to the above process cartridge is to use a spherically universal joint driving-coupling structure as a driving component located at a longitudinal end of a photosensitive drum. This driving-coupling structure is easily disengaged from the driving component. Especially during a transportation process, this phenomenon occurs more easily, which causes the driving component to lose function and work unstably.

SUMMARY OF THE INVENTION

The primary object of the present invention is to provide a driving component with improved structure and reliable performance.

Another object of the present invention is to provide a photosensitive drum comprising the driving component with improved structure and reliable performance.

A further object is to provide a process cartridge comprising the driving component with improved structure and reliable performance.

In order to achieve the above objects, a driving component provided in the present invention comprises a gear having one fixed end and a longitudinal regulating component having a rotational driving force receiver outside the other end projecting from the gear. The longitudinal regulating component is provided within the gear by being moved reciprocally and translationally along the longitudinal direction of the gear and a first direction perpendicular to the longitudinal direction relative to the gear. A spring support part and a longitudinal position limit part are provided between the longitudinal regulating component and the gear. The longitudinal regulating component comprises a first motion subassembly, a groove part and a central shaft part. The groove part has an upper chute and a lower chute, which are orthogonal in space. The first motion subassembly forms relative slide coordination with the upper chute along the first direction. The central shaft part has a common axis with the gear and forms relative slide coordination with the lower chute along a second direction. The first direction and the second direction are all perpendicular to the longitudinal direction of the gear.

A further plan is to provide the first motion subassembly comprising the rotational driving force receiver and a regulating slider. The rotational driving force receiver can be rationally connected to the regulating slider around its own axis within a certain angel. A rotation limiting pin is provided between the rotational driving force receiver and the regulating slider.

A further plan is to provide the rotational driving force receiver comprising an outer end portion, a middle portion and a shaft portion on which a pinhole allowing the rotation limiting pin to pass through is provided. A concave spherical surface is formed at the center position of the outer end portion. A first convex claw and a second convex claw projecting longitudinally, and a first section and a second section separated by the first convex claw and the second convex claw are formed around the circumference of the spherical surface. The surface of the first convex claw has a first engaged surface, a first bevel and a second bevel; and the surface of the second convex claw has a second engaged surface, a third bevel and a fourth bevel, in which the first bevel, the second bevel, the third bevel and the fourth bevel are all formed around the circumferential edge of the outer end portion.

A further plan is to provide that the first convex claw and the second convex claw, and the first section and the second section are centrally symmetric to the axis of the rotational driving force receiver, respectively.

A further plan is to provide the regulating slider comprising a base and a boss formed on the base. A through hole penetrating longitudinally is provided inside the boss. The diameter of the through hole is larger than the diameter of the shaft portion of the rotational driving force receiver but smaller than the diameter of the middle portion of the rotational driving force receiver. A first side of the base has a first position limit protrusion protruding outward and the second side has a second position limit protrusion protruding outward. The bottom of the base has a recess accommodating the rotation limiting pin. The recess is formed around the circumference of the through hole. A first position limit block and a second position limit block are provided oppositely inside the recess.

A further plan is to provide the central shaft part comprising a head and a rod. The head has a thin plate shaped like a drum. The rod has a cross section shaped like a drum, whose area is smaller than the area of the head. The longitudinal position limit part is a position limit clevis pin and the bottom of the rod portion has a pinhole penetrating the rod portion in a radial direction. The pinhole is fit with the position limit clevis pin.

In addition, the outer peripheral surface of the gear has a transmission tooth ring. A divisional plate perpendicular to the longitudinal direction and a gear cavity above the divisional plate are provided inside the gear. The center position of the divisional plate has a positioning seat which has opened a through hole. The through hole and the cross section of the rod portion are all shaped like a drum. The spring support part is a helical compression spring.

A photosensitive drum provided in the present invention comprises a main drum body and a driving component fixed at a longitudinal end of the main drum body. The driving component comprises a gear having one fixed end and a longitudinal regulating component having a rotational driving force receiver outside the other end projecting from the gear. The longitudinal regulating component is provided within the gear by being moved reciprocally and translationally along the longitudinal direction of the gear and a first direction perpendicular to the longitudinal direction relative to the gear. A spring support part and a longitudinal position limit part are provided between the longitudinal regulating component and the gear. The longitudinal regulating component comprises a first motion subassembly, a groove part and a central shaft part. The groove part has an upper chute and a lower chute, which are orthogonally in space. The first motion subassembly forms relative slide coordination with the upper chute along the first direction. The central shaft part has a common axis with the gear and forms relative slide coordination with the lower chute along a second direction. The first direction and the second direction are all perpendicular to the longitudinal direction of the gear.

A further plan is to provide the first motion subassembly comprising the rotational driving force receiver and a regulating slider. The rotational driving force receiver can be rotationally connected to the regulating slider around its own axis within a certain angel. A rotation limiting pin is provided between the rotational force receiver and the regulating slider.

A further plan is to provide the rotational driving force receiver comprising an outer end portion, a middle portion and a shaft portion on which a pinhole allowing the rotation limiting pin to pass through is provided. A concave spherical surface is formed at the center position of the outer end portion. A first convex claw and a second convex claw projected longitudinally, and a first section and a second section separated by the first convex claw and the second convex claw are formed around the circumference of the spherical surface. The surface of the first convex claw has a first engaged surface, a first bevel and a second bevel; and the surface of the second convex claw has a second engaged surface, a third bevel and a fourth bevel, in which the first bevel, the second bevel, the third bevel and the fourth bevel are all formed around the circumferential edge of the outer end portion. The first convex claw and the second convex claw, and the first section and the second section are centrally symmetric to the axis of the rotational driving force receiver, respectively. The regulating slider comprises a base and a boss formed on the base. A through hole penetrating longitudinally is provided inside the boss. The diameter of the through hole is larger than the diameter of the shaft portion of the rotational driving force receiver but smaller than the diameter of the middle portion of the rotational driving force receiver. A first side of the base has a first position limit protrusion protruding outward and a second side has a second position limit protrusion protruding outward. The bottom of the base has a recess accommodating the rotation limiting pin. The recess is formed around the circumference of the through hole. A first position limit block and a second position limit block are provided oppositely inside the recess.

In addition, the central shaft part comprises a head and a rod. The head has a thin plate shaped like a drum. The rod has a cross section shaped like a drum, whose area is smaller than the area of the head. The longitudinal position limit part is a position limit clevis pin and the bottom of the rod has a pinhole penetrating the rod in a radial direction. The pinhole is fit with the position limit clevis pin. The outer peripheral surface of the gear has a transmission tooth ring. A divisional plate perpendicular to the longitudinal direction and a gear cavity above the divisional plate are provided inside the gear. The center position of the divisional plate has a positioning seat which has opened a through hole. The through hole and the cross section of the rod are all shaped like a drum. The spring support part is a helical compression spring.

A process cartridge provided in the present invention comprises a cartridge and a photosensitive drum assembled rotationally inside the cartridge. The photosensitive drum comprises a main drum body and a driving component fixed at a longitudinal end of the main drum body. The driving component comprises a gear having one fixed end and a longitudinal regulating component having a rotational driving force receiver outside the other end projecting from the gear. The longitudinal regulating component is provided within the gear by being moved reciprocally and translationalyl along the longitudinal direction of the gear and a first direction perpendicular to the longitudinal direction relative to the gear. A spring support part and a longitudinal position limit part are provided between the longitudinal regulating component and the gear. The longitudinal regulating component comprises a first motion subassembly, a groove part and a central shaft part. The groove part has an upper chute and a lower chute, which are orthogonally in space. The first motion subassembly part forms relative slide coordination with the upper chute along the first direction. The central shaft part has a common axis with the gear and forms relative slide coordination with the lower chute along a second direction. The first direction and the second direction are all perpendicular to the longitudinal direction of the gear.

A further plan is to provide the first motion subassembly comprising the rotational driving force receiver and a regulating slider. The rotational driving force receiver can be rotationally connected to the regulating slider around its own axis within a certain angel. A rotation limiting pin is provided between the rotational force receiver and the regulating slider.

A further plan is to provide the rotational driving force receiver comprising an outer end portion, a middle portion and a shaft portion on which a pinhole allowing the rotation limiting pin to pass through is provided. A concave spherical surface is formed at the center position of the outer end portion. A first convex claw and a second convex claw projected longitudinally, and a first section and a second section separated by the first convex claw and the second convex claw are formed around the circumference of the spherical surface. The surface of the first convex claw has a first engaged surface, a first bevel and a second bevel; and the surface of the second convex claw has a second engaged surface, a third bevel and a fourth bevel, in which the first bevel, the second bevel, the third bevel and the fourth bevel are all formed around the circumferential edge of the outer end portion. The first convex claw and the second convex claw, and the first section and the second section are centrally symmetric to the axis of the rotational driving force receiver, respectively. The regulating slider comprises a base and a boss formed on the base. A through hole penetrating longitudinally is provided inside the boss. The diameter of the through hole is larger than the diameter of the shaft portion of the rotational driving force receiver but smaller than the diameter of the middle portion of the rotational driving force receiver. A first side of the base has a first position limit protrusion protruding outward and a second side has a second position limit protrusion protruding outward. The bottom of the base has a recess accommodating the rotation limiting pin. The recess is formed around the circumference of the through hole. A first position limit block and a second position limit block are provided oppositely inside the recess.

In addition, the central shaft part comprises a head and a rod. The head has a thin plate shaped like a drum. The rod has a cross section shaped like a drum, whose area is smaller than the area of the head. The longitudinal position limit part is a position limit clevis pin and the bottom of the rod portion has a pinhole penetrating the rod portion in a radial direction. The pinhole is fit with the position limit clevis pin. The outer peripheral surface of the gear has a transmission tooth ring. A divisional plate perpendicular to the longitudinal direction and a gear cavity above the divisional plate are provided inside the gear. The center position of the divisional plate has a positioning seat which has opened a through hole. The through hole and the cross section of the rod portion are all shaped like a drum. The spring support part is a helical compression spring.

DETAILED DESCRIPTION OF THE PRESENTLY PREFERRED EMBODIMENTS

The process cartridge in the present invention is identical to various types of the current process cartridges described in Background Art of the present patent application. The photosensitive drum of the present invention is identical to those published in the current literature. The only difference is the driving component constructed at the longitudinal end of the photosensitive drum. Thus, only the embodiment of the driving component is described in detail as follows. Other embodiments related to the process cartridge and the photosensitive drum will not be described herein.

Figure 1:
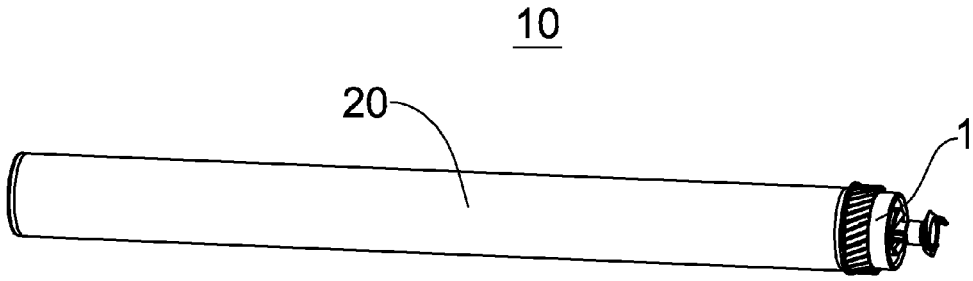
FIG. 1 is a perspective view illustrating one embodiment of a photosensitive drum.

FIG. 1 shows an embodiment of a photosensitive drum 10 constituting a driving component 1 in the present invention.

The driving component 1 is fixed at one end of a main drum body 20 of the photosensitive drum 10. The main drum body 20 has a photosensitive layer at its peripheral surface. The driving component 1 is used to receive a rotational driving force from a printer's driving mechanism and transmit the rotational driving force to the main drum body 20. The main drum body 20 rotates around its axis under the rotational driving force.

Figure 2:
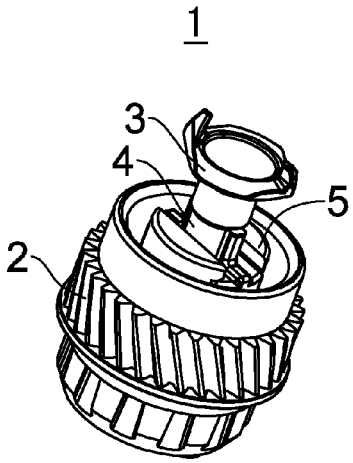
FIG. 2 is a perspective view illustrating one embodiment of a driving component shown in FIG. 1.
Figure 3:
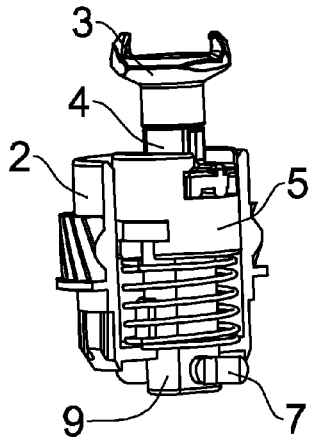
FIG. 3 is a perspective view in partial cut-away of the driving component shown in FIG. 2.
Figure 4:
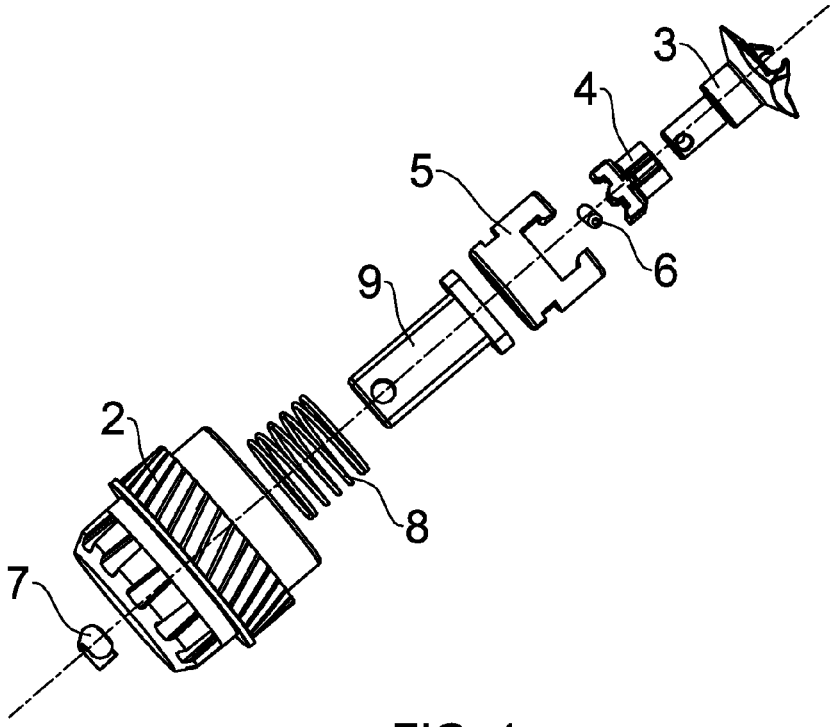
FIG. 4 is an exploded view of the driving component shown in FIG. 2.

FIGS. 2-4 show the basic constructions of the driving component 1, which mainly comprises a gear 2, a rotational driving force receiver 3, a regulating slider 4, a groove part 5, a rotation limiting pin 6, a central shaft part 9, a position limit clevis pin 7 and a helical compression spring 8. The gear 2 is fixed at one end of the main drum body 20. The axis of the gear 2 coincides with the axis of the main drum body 20. The gear 2 rotates synchronously with the main drum body 20 around their common axis. The rotational driving force receiver 3 is connected to the regulating slider 4 through the rotation limiting pin 6. The rotational driving force receiver 3 can rotate reciprocally around its axis within a certain angular range relative to the regulating slider 4. The helical compression spring 8 is set on the central shaft part 9. The central shaft part 9 is assembled inside the gear 2 through the position limit clevis pin 7.

Figure 15:
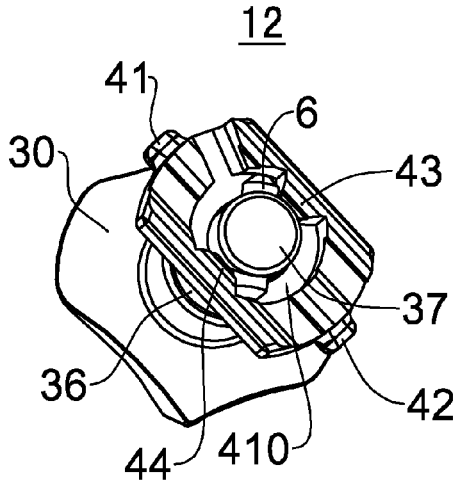
FIG. 15 is a bottom view of the first motion subassembly shown in FIG. 14.
Figure 16:
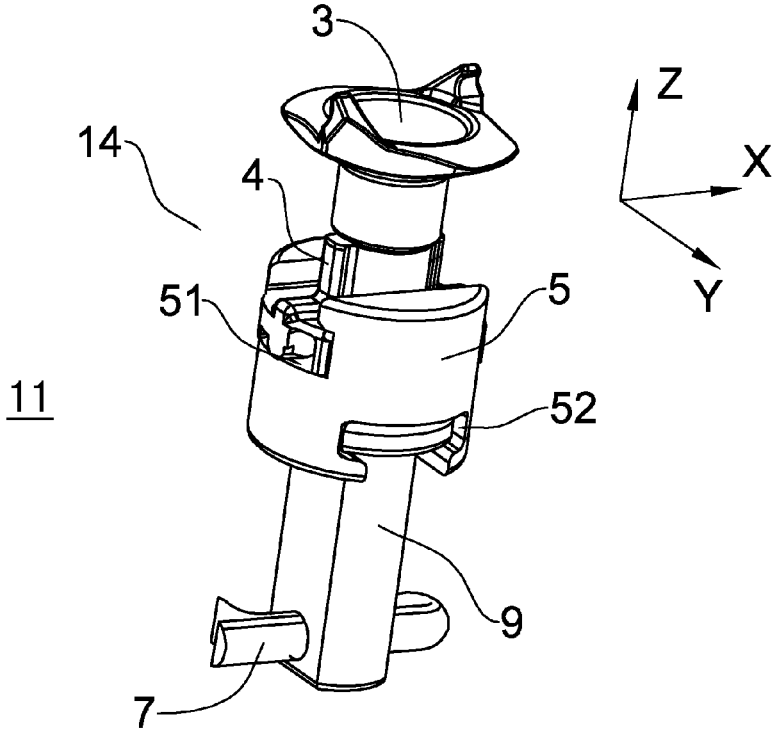
FIG. 16 is a perspective view illustrating a longitudinal regulating component of the driving component shown in FIG. 2.
Figure 17A:
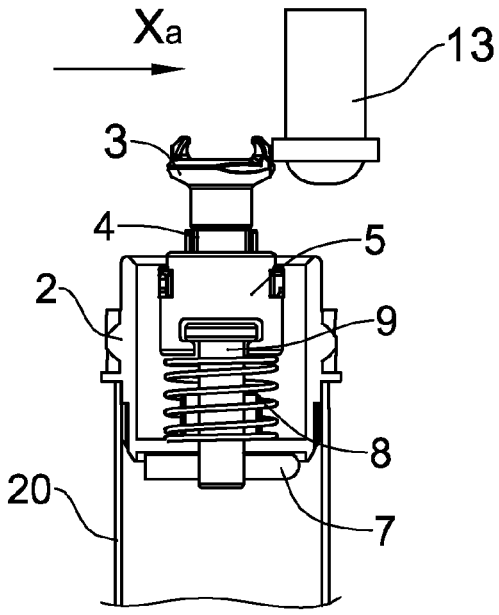
FIGS. 17*a*-17*d* are schematic diagrams illustrating a coordination process of the driving component and a printer's driving head when a process cartridge of the photosensitive drum shown in FIG. 1 is engaged into a printer.
Figure 17B:
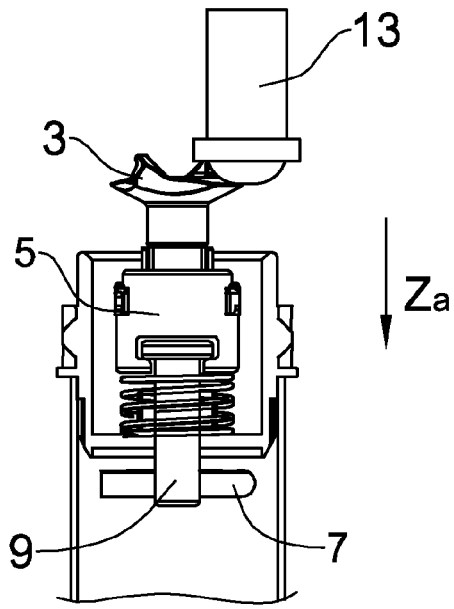
Figure 17C:
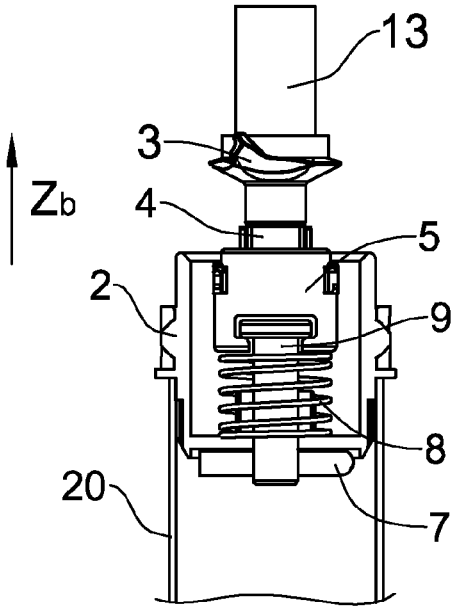
Figure 17D:
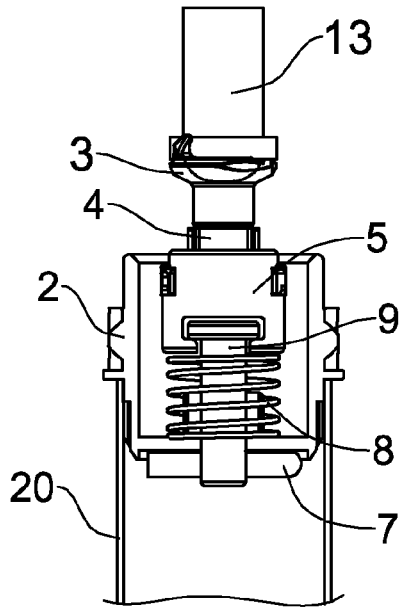
Figure 18A:
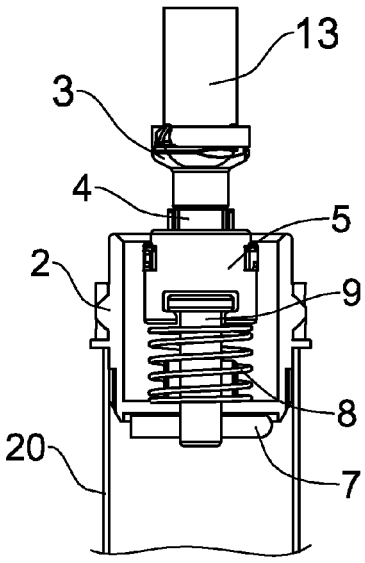
FIGS. 18*a*-18*d* are schematic diagrams illustrating a coordination process of the driving component and the printer's driving head when the process cartridge of the photosensitive drum shown in FIG. 1 is disengaged from the printer.
Figure 18B:
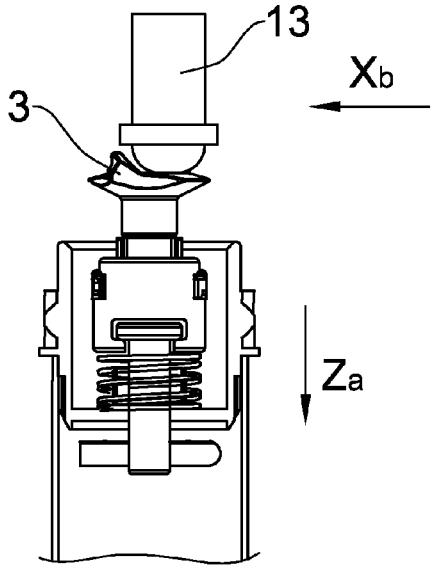
Figure 18C:
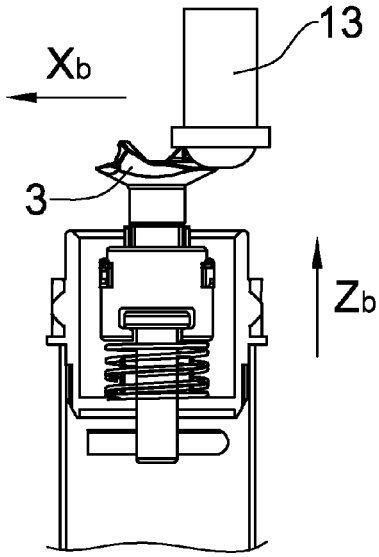
Figure 18D:
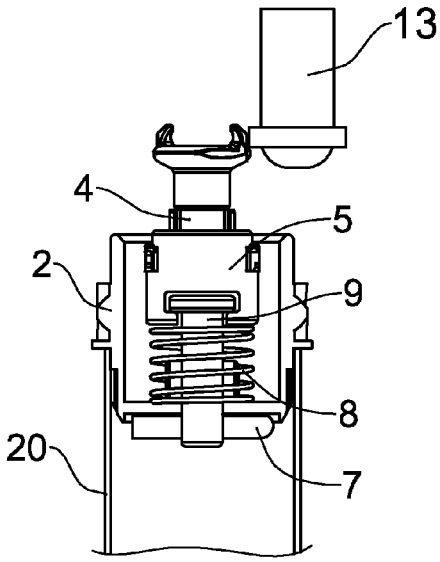

Referring to FIG. 16, a longitudinal regulating component 11 comprises a rotational driving force receiver 3, a regulating slider 4, a rotation limiting pin 6, a groove part 5 and a central shaft part 9. Referring to FIGS. 17 and 18, the longitudinal regulating component 11 can make a limited longitudinal and reciprocally translational movement along the longitudinal direction Z of the gear 2 relative to the gear 2 via the compressed force of the helical compression spring 8, the restoring force after losing the external force from the helical compression spring 8 and the longitudinal position limit from the position limit clevis pin 7. In addition, referring to FIGS. 14 and 15, a first motion subassembly 12 comprising a rotational driving force receiver 3, a regulating slider 4 and a rotation limiting pin 6 can make a limited first straight line reciprocally translational movement inside an upper chute 51 along the first direction X perpendicular to the longitudinal direction Z of the gear 2 relative to the groove part 5. A second motion subassembly 14 of the first motion subassembly 12 plus the groove part 5 can make a limited second straight line reciprocally translational movement along the second direction Y perpendicular to the longitudinal direction Z of the gear 2 relative to the central shaft part 9. The first direction X is orthogonal to the second direction Y.

Figure 5:
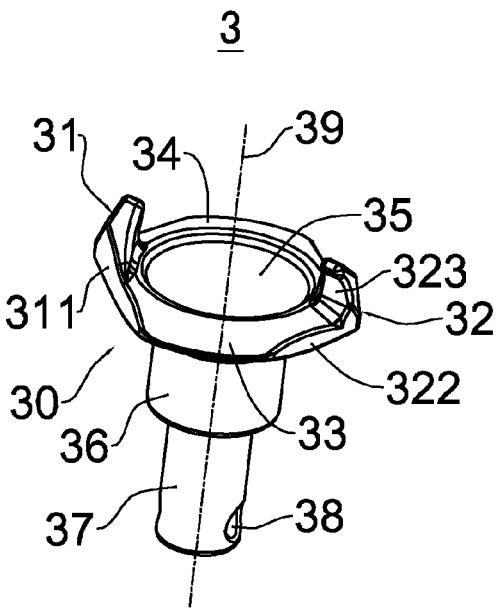
FIG. 5 is a perspective view illustrating a rotational driving force receiver shown in FIG. 4.
Figure 6:
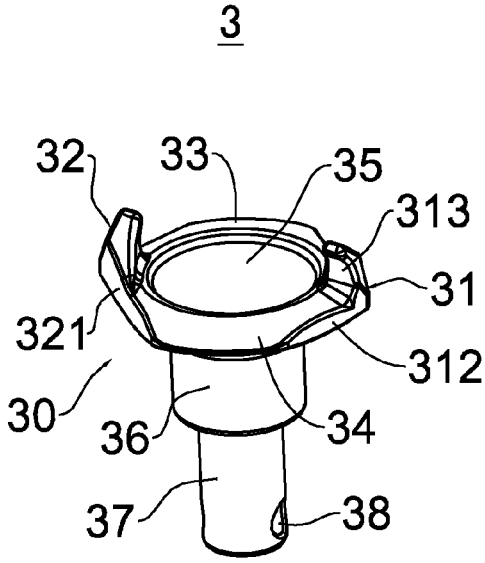
FIG. 6 is a back view of the rotational driving force receiver shown in FIG. 5.

Referring to FIG. 5 and FIG. 6, the rotational driving force receiver 3 is roughly a similar shape of the torch, which comprises an outer end portion 30, a middle portion 36 and a shaft portion 37 tapered from top to bottom as shown in FIG. 5. The middle portion 36 and the shaft portion 37 are all cylindrical. A pinhole 38 is provided on the shaft portion 37, which allows the rotation limiting pin 6 passes through. A concave spherical surface 35 is formed in the center position of the outer end portion 30. A first convex claw 31 and a second convex claw 32 projected longitudinally are formed around the circumference of the spherical surface 35. The first convex claw 31 and the second convex claw 32 are centrally symmetric to the axis 39 of the rotational driving force receiver 3. In addition, a first section 33 and a second section 34 separated by the first convex claw 31 and the second convex claw 32 are formed around the circumference of the spherical surface 35 and are also centrally symmetric to the axis 39. The surface of the first convex claw 31 has a first engaged surface 313, a first bevel 311 and a second bevel 312. The surface of the second convex claw 32 has a second engaged surface 323, a third bevel 321 and a fourth bevel 322, in which the first engaged surface 313 and the second engaged surface 323, the first bevel 311 and the third bevel 321, and the second bevel 312 and the fourth bevel 322 are centrally symmetric to the axis 39, respectively. The first bevel 311, the second bevel 312, the third bevel 321 and the fourth bevel 322 are all formed around the circumferential edge of the outer end portion 30.

Figure 7:
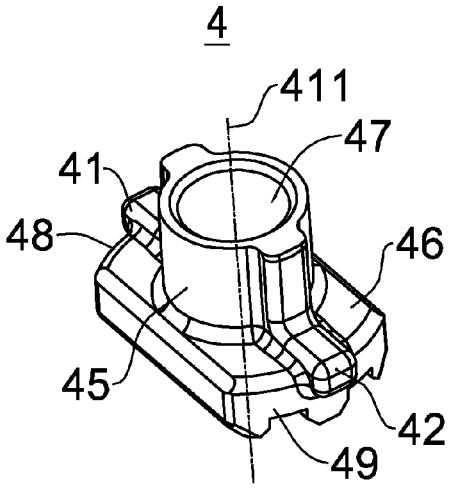
FIG. 7 is a perspective view illustrating a regulating slider shown in FIG. 4.
Figure 8:
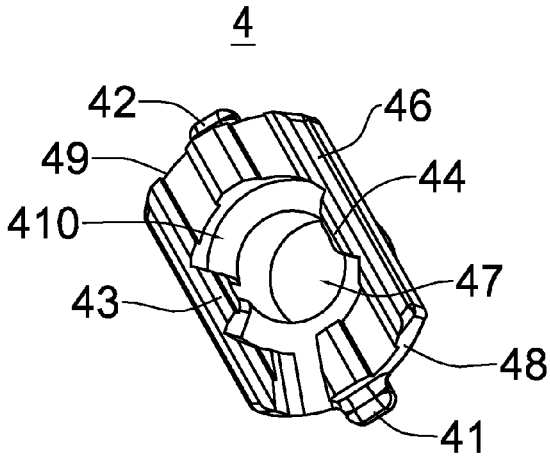
FIG. 8 is a bottom view of the regulating slider shown in FIG. 7.

Referring to FIG. 7 and FIG. 8, a regulating slider 4 comprises a base 46 shaped roughly like a drum and a cylindrical boss 45 formed on the base 46. There is a cylindrical through hole 47 penetrating longitudinally inside the boss 45. The diameter of the through hole 47 is larger than the diameter of the shaft portion 37 of the rotational driving force receiver 3 but smaller than the diameter of the middle portion 36 of the rotational driving force receiver 3. Thus the hole can only allow the shaft portion 37 to pass through. A first side 48 of the base 46 has a first position limit protrusion 41 protruding outward and a second side 49 has a second position limit protrusion 42 protruding outward. The role of the above two position limit protrusions is to control the distance of which the regulating slide 4 moves on the lateral surface inside the chute of the groove part 5. The bottom of the base 46 has a recess 410 accommodating the rotation limiting pin 6. The recess 410 is formed around the circumference of the through hole 47. Two opposite blocks, namely a first position limit block 43 and a second position limit block 44 are provided inside the recess, which allow the rotation limiting pin 6 assembled in the pinhole 38 to rotate around the axis 411 of the regulating slider 4 within a certain angular range.

Figure 9:
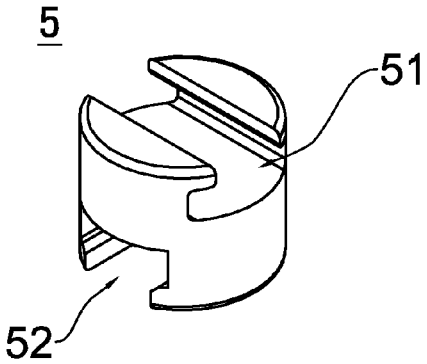
FIG. 9 is a perspective view illustrating a groove part shown in FIG. 4.

Referring to FIG. 9, the groove part 5 is a cylinder that has opened a groove. Its top has an upper chute 51 penetrating in the radial direction and the bottom has a lower chute 52 penetrating in the radial direction. The cross sections of the upper chute 51 and the lower chute 52 show roughly a convex shape. The upper chute and the lower chute are orthogonal in space. The base 46 of the regulating slider 4 can reciprocally slide along the radial direction inside the upper chute 51 relative to the groove part 5. The head of the central shaft part 9 can reciprocally slide along the radial direction inside the lower chute 52 relative to the groove part 5.

Figure 10:
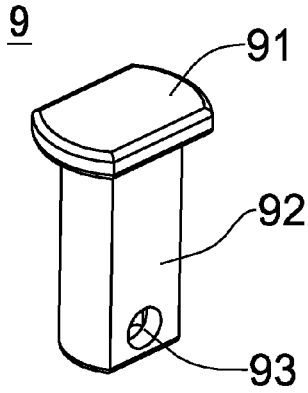
FIG. 10 is a perspective view illustrating a central shaft part shown in FIG. 4.
Figure 11:
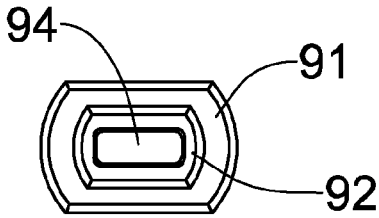
FIG. 11 is a top view of the central shaft part shown in FIG. 10.

Referring to FIGS. 10 and 11, the central shaft part 9 comprising a head 91 and a rod 92 is roughly like a T-shape, in which the head 91 comprises a thin plate shaped like a drum and the cross section of the rod 92 shaped also like a drum but the cross section area of the rod 92 is smaller than the area of the head 91. The bottom of the rod 92 has a pinhole 93 penetrating the rod 92 in the radial direction. The pinhole 93 is fit with the position limiting clevis pin 7. There is a cavity 94 inside the rod 92.

Figure 12:
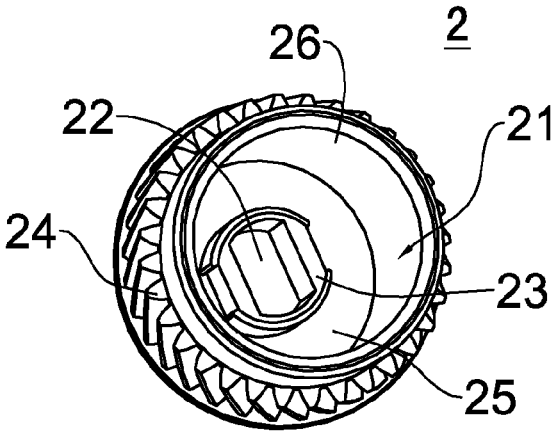
FIG. 12 is a perspective view illustrating a gear shown in FIG. 4.
Figure 13:
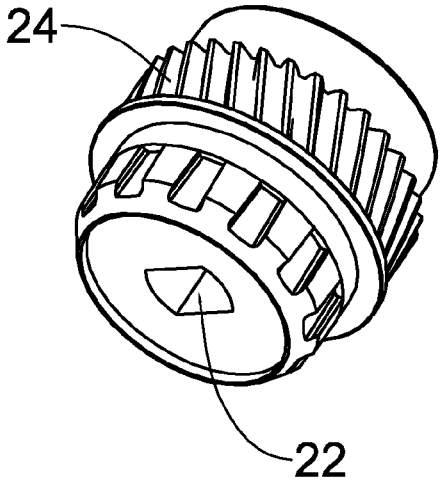
FIG. 13 is a perspective view illustrating the gear shown in FIG. 12 from another angle.

Referring to FIGS. 12 and 13, the outer peripheral surface of the gear 2 has a transmission tooth ring 24. A divisional plate 25 perpendicular to the longitudinal direction and a gear cavity 21 above the division 25 are provided inside the gear 2. A positioning seat 23 protruded upward is provided in the center of the divisional plate 25. The positioning seat 23 has opened a drum shaped hole 22. The size and shape of the drum shaped hole 22 are substantially identical to those of the cross section of the rod portion 92 on the central shaft part 9. The rod part 92 can only move longitudinally within the drum shaped hole 22. A position limit for the first straight line reciprocally transitional movement acted by the first motion subassembly 12 along the first direction X and for the second straight line reciprocally transitional movement acted by the second motion subassembly14 along the second direction Y is provided by the peripheral side wall 26 in the gear cavity 21.

Figure 14:
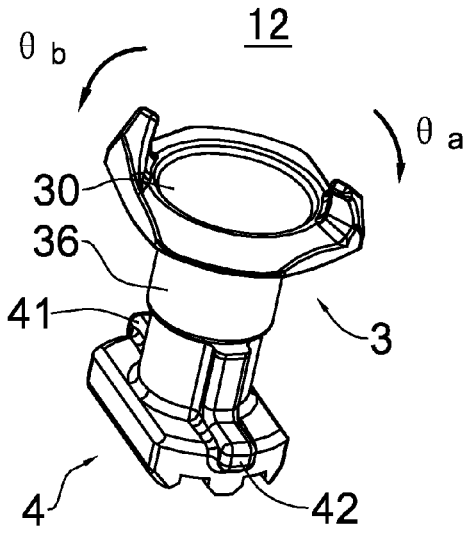
FIG. 14 is a perspective view illustrating a first motion subassembly of the driving component shown in FIG. 2.

Referring to FIGS. 14 and 15, the motion subassembly 12 comprises a rotational driving force receiver 3, a regulating slider 4 and a rotation limiting pin 6. The shaft portion 37 of the rotational driving force receiver 3 penetrates the through hole 47 of the regulating slider 4. The rotation limiting pin 6 passes through the pinhole 38 on the shaft portion 37 and is set inside the recess 410 of the bottom of the regulating slider 4.

Referring to FIG. 16, the longitudinal regulating component 11 comprises a rotational driving force receiver 3, a regulating slider 4, a rotation limiting pin 6, a groove part 5 and a central shaft part 9. The longitudinal regulating component 11 can make a longitudinal and reciprocally transitional movement along the axis Z of the photosensitive drum relative to the gear 2 via compressing from the helical compression spring 8.

FIGS. 17*a*-17*d* show schematic diagrams of a working process in which a process cartridge assembled the driving component 1 (only the end of the photosensitive drum is shown) is engaged into a printer. The process cartridge is engaged into the printer along the direction Xa perpendicular to the axis of the photosensitive drum. FIGS. 18*a*-18*d* show schematic diagrams of a working process in which the process cartridge assembled the driving component 1 is disengaged from the printer. The process cartridge is disengaged from the printer along the direction Xb perpendicular to the axis of the drum. The longitudinal regulating component 11 inside the driving component 1 moves inward overall along the direction Za while the longitudinal regulating component 11 moves outward overall along the direction Zb. Referring to FIG. 14, $\theta_a$ represents a clockwise rotary direction of the rotational driving force receiver 3 and $\theta_b$ represents a counterclockwise rotary direction of the rotational driving force receiver 3.

Its working process is described as follows:

1. Pushing a process cartridge into a printer along the direction Xa.

2. Referring to FIGS. 17*a*- 17*d*, when the driving component 1 on the process cartridge is put into the printer along the direction Xa and contacts the printer's driving shaft 13, two cases are required to be illustrated separately.

1) If the initial contact position is the first convex claw 31, the printer's driving shaft 13 will touch the two bevels 311, 312 of the first convex claw 31. One of the two surfaces will inevitably receive a weak stress. When the second bevel 312 receives the weak stress, the printer's driving shaft 13 rubs against the second bevel 312 pushing the rotational driving force receiver 3 to rotate a certain angle along the direction $\theta_a$, and then the printer's driving shaft 13 can automatically be plunged into the second section 34 adjacent to the second bevel 312 causing the longitudinal regulating component 11 in the driving component 1 to move overall along the direction Za. When the first bevel 311 receives the weak stress, the printer's driving shaft 13 rubs against the first bevel 311 pushing the rotational driving force receiver 3 to rotate a certain angle along the direction $\theta_b$, and then the printer's driving shaft 13 can automatically be plunged into the first section 33 adjacent to the first bevel 311 causing the longitudinal regulating component 11 in the driving component 1 to move overall along the direction Za. Since the second convex claw 32 is centrally symmetric to the first convex claw 31, its movement process is similar as the above process when the initial contact position is the second convex claw 32.

2). If the initial contact position is the first section 33 or the second section 34, the printer's driving shaft 13 will automatically plunged into the first section 33 or the second section 34 causing the longitudinal regulating component 11 in the driving component 1 to move overall along the direction Za.

3. The moving displacement of the longitudinal adjustment component 11 in the driving component 1 overall along the direction Za is increased gradually as being moved in the direction Xa. After the printer's driving shaft 13 contacts the edge of the spherical surface 35, the longitudinal regulating component 11 in the driving component 1 moves overall along the direction Zb until the top of the printer's driving shaft 13 substantially coincides with the spherical surface 35.

4. When the printer starts, the printer's driving shaft 13 will automatically be coupled with the rotational driving force receiver 3, which receives the rotational driving force from the printer to drive the main drum body 20 of the photosensitive drum to rotate.

5. When the rotational driving force receiver 3 receives the driving force from the printer, the driving force from the printer may not be a constant value. Through a variable value generated from the first motion subassembly 12 and the second motion subassembly 14 in the driving component 1 being moved alternatively in a straight line in a small range to buffer the printer's driving force, the photosensitive drum can rotate smoothly not generating jump and undulation and the process cartridge can work normally having excellent printing quality.

6. Referring to FIGS. 18*a*-18*d*, when the process cartridge is taken out from the printer after it stops running, the process cartridge initially moves along the direction Xb and the printer's driving shaft 13 begins to be separated from the rotational driving force receiver 3.

7. When the printer's driving shaft 13 contacts the edge of the spherical surface 35, the longitudinal regulating component 11 in the driving component 1 moves overall along the direction Za.

8. As the amount of the moving displacement of the longitudinal regulating component 11 overall along the direction Za is increased, if the printer's driving shaft meets the first convex claw 31 or the second convex claw 32, the rotational driving force receiver 3 will be pushed to rotate an angle along the direction $\theta_a$ or $\theta_b$ causing the printer's driving shaft 13 to be plunged into the first section 33 or the second section 34.

9. When the printer's driving shaft 13 is plunged into the first section 33 or the second section 34, the longitudinal regulating component 11 moves overall along the direction Zb and the process cartridge can be taken out from the printer until the amount of the moving displacement becomes zero.

The above is only the optimal embodiment of the present invention. It should be pointed out that under the premise not deviating from the present inventive concept, one of ordinary skill in the art can make many changes and modifications without deviating from the protection range of the present invention. For example, the position limit clevis pin can be realized by adopting other longitudinal position limit structures that can be easily thought by one of ordinary skill in the art. The longitudinal limit structure can be an independent structure separated from the central shaft part or a part formed on the central shaft part. In addition, the spring support part can be substituted by the spring parts other than the helical compression spring, e.g., a compressible elastic plastic member. The shapes of the cross section of the central shaft part and the through hole on the divisional plate of the gear are not limited to drum shapes but can also be rectangular, parallel quadrilateral and any other shapes with two parallel lines as long as the longitudinal regulating component can only make translational movement along the longitudinal direction relative to the gear but not make translational movement in a radial direction relative to the gear and rotate around the axis.

INDUSTRIAL APPLICABILITY

Since a longitudinal regulating component of a driving component in the present invention is provided within a gear by being moved reciprocally and translationally along the gear's longitudinal direction and a spring support part and a longitudinal position limit part are provided between the longitudinal regulating component and the gear, a rotational driving force receiver of the longitudinal regulating component always keeps consistent with the gear's longitudinal direction under the spring support part's action when a process cartridge having the above driving component is assembled inside a printer. And since a longitudinal position limit part is provided, the longitudinal regulating component is not easily disengaged from the gear thus ensuring the work to be reliable and stable. When contacting with the printer's driving shaft, the rotational driving force receiver employs its own bevels to rub against the spherical surface of the printer's driving shaft and the printer's driving shaft presses the rotational driving force receiver to move along the longitudinal direction of the photosensitive drum (the gear). When the process cartridge is engaged in the working position inside a printer, the printer's driving shaft automatically aligns the rotational driving force receiver of the photosensitive drum driving component. When a printer starts, the printer's driving shaft may rotate idle to an angle at the beginning and then is engaged with two convex claws of the rotational driving force receiver thus driving the rotation of the photosensitive drum in the process cartridge to be rotated and letting the process cartridge powder to be developed. Therefore, the printing process of the printer is fulfilled. Because the longitudinal regulating component is kept on the center axis of the gear by using the central shaft part, to be kept in the center axis of the gear, the final driving force received by the longitudinal regulating component as well as the whole driving component can be guaranteed to be always engaged on the central axis of the gear and the photosensitive drum when the rotational force receiver receives the driving force given by a machine. Thus, the jump of the gear relative to the axis is greatly reduced.

What is claimed is:

1. A driving component comprising a gear having one fixed end; and a longitudinal regulating component having a rotational driving force receiver outside the other end projecting from the gear, wherein, the longitudinal regulating component being provided within the gear by being moved reciprocally and translationally along the longitudinal direction of the gear and a first direction perpendicular to the longitudinal direction relative to the gear, a spring support part and a longitudinal position limit part being provided between the longitudinal regulating component and the gear; and the longitudinal regulating component comprising a first motion subassembly, a groove part and a central shaft part, wherein the groove part has an upper chute and a lower chute which are orthogonal in space, the first motion subassembly forms relative slide coordination with the upper chute along the first direction, the central shaft part has a common axis with the gear and forms relative slide coordination with the lower chute along a second direction, and the first direction and the second direction are all perpendicular to the longitudinal direction of the gear.

2. The driving component according to claim 1, wherein, the first motion subassembly comprising the rotational driving force receiver and a regulating slider, wherein the rotational force receiver is rotationally connected to the regulating slider around its axis within a certain angle and a rotation limiting pin is provided between the rotational driving force receiver and the regulating slider.

3. The driving component according to claim 2, wherein, the central shaft part comprising a head and a rod, wherein the head has a thin plate shaped like a drum, the rod has a cross section shaped like a drum whose area is smaller than the area of the head, the longitudinal position limit part is a position limit clevis pin, the bottom of the rod has a pinhole penetrating the rod in a radial direction, and the pinhole is fit with the position limit clevis pin.

4. The driving component according to claim 3, wherein, the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod all being shaped like a drum; and the spring support part being a helical compression spring.

5. The driving component according to claim 2, wherein, the rotational driving force receiver comprising an outer end portion, a middle portion and a shaft portion on which a pinhole allowing the rotation limiting pin to pass through is provided, wherein a concave spherical surface is formed at the center position of the outer end portion; a first convex claw and a second convex claw projecting longitudinally, and a first section and a second section separated by the first convex claw and the second convex claw are formed around the circumference of the spherical surface; and the surface of the first convex claw has a first engaged surface, a first bevel and a second bevel, the surface of the second convex claw has a second engaged surface, a third bevel and a fourth bevel, in which the first bevel, the second bevel, the third bevel and the fourth bevel are all formed around the circumferential edge of the outer end portion.

6. The driving component according to claim 5, wherein, the central shaft part comprising a head and a rod, wherein the head has a thin plate shaped like a drum, the rod has a cross section shaped like a drum whose area is smaller than the area of the head, the longitudinal position limit part is a position limit clevis pin, the bottom of the rod has a pinhole penetrating the rod in a radial direction, and the pinhole is fit with the position limit clevis pin.

7. The driving component according to claim 6, wherein, the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod all being shaped like a drum; and the spring support part being a helical compression spring.

8. The driving component according to claim 5, wherein, the first convex claw and the second convex claw, and the first section and the second section being centrally symmetric to the axis of the rotational driving force receiver, respectively.

9. The driving component according to claim 8, wherein, the central shaft part comprising a head and a rod, wherein the head has a thin plate shaped like a drum, the rod has a cross section shaped like a drum whose area is smaller than the area of the head, the longitudinal position limit part is a position limit clevis pin, the bottom of the rod has a pinhole penetrating the rod in a radial direction, and the pinhole is fit with the position limit clevis pin.

10. The driving component according to claim 9, wherein, the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod all being shaped like a drum; and the spring support part being a helical compression spring.

11. The driving component according to claim 8, wherein, the regulating slider comprising a base and a boss formed on the base, wherein a through hole penetrating longitudinally is provided inside the boss, the diameter of the through hole is larger than the diameter of the shaft portion of the rotational driving force receiver but smaller than the diameter of the middle portion of the rotational driving force receiver, a first side of the base has a first position limit protrusion protruding outward and a second side has a second position limit protrusion protruding outward, the bottom of the base has a recess accommodating the rotation limiting pin, the recess is formed around the circumference of the through hole, and a first position limit block and a second position limit block are provided oppositely inside the recess.

12. The driving component according to claim 11, wherein, the central shaft part comprising a head and a rod, wherein the head has a thin plate shaped like a drum, the rod has a cross section shaped like a drum whose area is smaller than the area of the head, the longitudinal position limit part is a position limit clevis pin, the bottom of the rod has a pinhole penetrating the rod in a radial direction, and the pinhole is fit with the position limit clevis pin.

13. The driving component according to claim 12, wherein, the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod all being shaped like a drum; and the spring support part being a helical compression spring.

14. A photosensitive drum, comprising:

a main drum body and a driving component fixed at a longitudinal end of the main drum body;

the driving component comprising a gear having one fixed end, a longitudinal regulating component and a rotational driving force receiver outside the other end projecting from the gear, wherein, the longitudinal regulating component being provided within the gear by being moved reciprocally and translationally along the longitudinal direction of the gear and a first direction perpendicular to the longitudinal direction relative to the gear, a spring support part and a longitudinal position limit part being provided between the longitudinal regulating component and the gear; and the longitudinal regulating component comprising a first motion subassembly, a groove part and a central shaft part, wherein the groove part has an upper chute and a lower chute which are orthogonal in space, the first motion subassembly forms relative slide coordination with the upper chute along the first direction, the co-axis of the central shaft and the gear forms relative slide coordination with the lower chute along a second direction, and the first direction and the second direction are all perpendicular to the longitudinal direction of the gear.

15. The photosensitive drum according to claim 14, wherein, the central shaft comprising a head and a rod, wherein the head has a thin plate shaped like a drum, the rod has a cross section shaped like a drum whose area is smaller than the area of the head, the longitudinal position limit part is a position limit clevis pin, and the bottom of the rod has a pinhole penetrating the rod in a radial direction, and the pinhole is fit with the position limit clevis pin;

the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod all being shaped like a drum; and the spring support part being a helical compression spring.

16. The photosensitive drum according to claim 14, wherein, the first motion subassembly comprising the rotational driving force receiver and a regulating slider, wherein the rotational force receiver is rotationally connected to the regulating slider around its own axis within a certain angle and a rotation limiting pin is provided between the rotational driving force receiver and the regulating slider.

17. The photosensitive drum according to claim 16, wherein, the central shaft comprising a head and a rod, wherein the head has a thin plate shaped like a drum, the rod has a cross section shaped like a drum whose area is smaller than the area of the head, the longitudinal position limit part is a position limit clevis pin, and the bottom of the rod has a pinhole penetrating the rod in a radial direction, and the pinhole is fit with the position limit clevis pin;

the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod all being shaped like a drum; and the spring support part being a helical compression spring.

18. The photosensitive drum according to claim 16, wherein, the rotational driving force receiver comprising an outer end portion, a middle portion and a shaft portion on which a pinhole allowing the rotation limiting pin to pass through is provided, wherein a concave spherical surface is formed at the center position of the outer end portion; a first convex claw and a second convex claw projected longitudinally, and a first section and a second section separated by the first convex claw and the second convex claw are formed around the circumference of the spherical surface; and the surface of the first convex claw has a first engaged surface, a first bevel and a second bevel, the surface of the second convex claw has a second engaged surface, a third bevel and a fourth bevel, in which the first bevel, the second bevel, the third bevel and the fourth bevel are all formed around the circumferential edge of the outer end portion;

the first convex claw and the second convex claw, and the first section and the second section being centrally symmetric to the axis of the rotational driving force receiver, respectively; and the regulating slider comprising a base and a boss formed on the base, wherein a through hole penetrating longitudinally is provided inside the boss, the diameter of the through hole is larger than the diameter of the shaft portion of the rotational driving force receiver but smaller than the diameter of the middle portion of the rotational driving force receiver, a first side of the base has a first position limit protrusion protruding outward and a second side has a second position limit protrusion protruding outward, the bottom of the base has a recess accommodating the rotation limiting pin, the recess is formed around the circumference of the through hole, and a first position limit block and a second position limit block are provided oppositely inside the recess.

19. The photosensitive drum according to claim 18, wherein, the central shaft comprising a head and a rod, wherein the head has a thin plate shaped like a drum, the rod has a cross section shaped like a drum whose area is smaller than the area of the head, the longitudinal position limit part is a position limit clevis pin, and the bottom of the rod has a pinhole penetrating the rod in a radial direction, and the pinhole is fit with the position limit clevis pin;

the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod all being shaped like a drum; and the spring support part being a helical compression spring.

20. A process cartridge, comprising a cartridge; and a photosensitive drum assembled rotationally inside the cartridge, the photosensitive drum comprising a main drum body and a driving component fixed at a longitudinal end of the main drum body;

the driving component comprising a gear having one fixed end, a longitudinal regulating component and a rotational driving force receiver outside the other end projecting from the gear, wherein, the longitudinal regulating component being provided within the gear by being moved reciprocally and translationally along the longitudinal direction of the gear and a first direction perpendicular to the longitudinal direction relative to the gear, a spring support part and a longitudinal position limit part being provided between the longitudinal regulating component and the gear; and the longitudinal regulating component comprising a first motion subassembly, a groove part and a central shaft part, wherein the groove part has an upper chute and a lower chute which are orthogonal in space, the first motion subassembly forms relative slide coordination with the upper chute along the first direction, the co-axis of the central shaft and the gear forms relative slide coordination with the lower chute along a second direction, and the first direction and the second direction are all perpendicular to the longitudinal direction of the gear.

21. The process cartridge according to claim 20, wherein, the central shaft comprising a head and a rod, wherein the head has a thin plate shaped like a drum, the rod has a cross section shaped like a drum whose area is smaller than the area of the head, the longitudinal position limit part is a position limit clevis pin, and the bottom of the rod has a pinhole penetrating the rod in a radial direction, and the pinhole is fit with the position limit clevis pin;

the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod portion all being shaped like a drum; and the spring support part being a helical compression spring.

22. The process cartridge according to claim 20, wherein, the first motion subassembly comprising the rotational driving force receiver and a regulating slider, wherein the rotational force receiver is rotationally connected to the regulating slider around its own axis within a certain angle and a rotation limiting pin is provided between the rotational driving force receiver and the regulating slider.

23. The process cartridge according to claim 22, wherein, the central shaft comprising a head and a rod, wherein the head has a thin plate shaped like a drum, the rod has a cross section shaped like a drum whose area is smaller than the area of the head, the longitudinal position limit part is a position limit clevis pin, and the bottom of the rod has a pinhole penetrating the rod in a radial direction, and the pinhole is fit with the position limit clevis pin;

the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod portion all being shaped like a drum; and the spring support part being a helical compression spring.

24. The process cartridge according to claim 22, wherein, the rotational driving force receiver comprising an outer end portion, a middle portion and a shaft portion on which a pinhole allowing the rotation limiting pin to pass through is provided, wherein a concave spherical surface is formed at the center position of the outer end portion; a first convex claw and a second convex claw projected longitudinally, and a first section and a second section separated by the first convex claw and the second convex claw are formed around the circumference of the spherical surface;

and the surface of the first convex claw has a first engaged surface, a first bevel and a second bevel, the surface of the second convex claw has a second engaged surface, a third bevel and a fourth bevel, in which the first bevel, the second bevel, the third bevel and the fourth bevel are all formed around the circumferential edge of the outer end portion;

the first convex claw and the second convex claw, and the first section and the second section being centrally symmetric to the axis of the rotational driving force receiver, respectively; and the regulating slider comprising a base and a boss formed on the base, wherein a through hole penetrating longitudinally is provided inside the boss, the diameter of the through hole is larger than the diameter of the shaft portion of the rotational driving force receiver but smaller than the diameter of the middle portion of the rotational driving force receiver, a first side of the base has a first position limit protrusion protruding outward and a second side has a second position limit protrusion protruding outward, the bottom of the base has a recess accommodating the rotation limiting pin, the recess is formed around the circumference of the through hole, and a first position limit block and a second position limit block are provided oppositely inside the recess.

25. The process cartridge according to claim 24, wherein, the central shaft comprising a head and a rod, wherein the head has a thin plate shaped like a drum, the rod has a cross section shaped like a drum whose area is smaller than the area of the head, the longitudinal position limit part is a position limit clevis pin, and the bottom of the rod has a pinhole penetrating the rod in a radial direction, and the pinhole is fit with the position limit clevis pin;

the outer peripheral surface of the gear having a transmission tooth ring; a divisional plate perpendicular to the longitudinal direction and a gear cavity above the divisional plate being provided inside the gear, wherein the center position of the divisional plate has a positioning seat which has opened a through hole;

the through hole and the cross section of the rod portion all being shaped like a drum; and the spring support part being a helical compression spring.

* * * * *